US005832633A

United States Patent [19]

Wang

[11] Patent Number: 5,832,633

[45] Date of Patent: Nov. 10, 1998

[54] TOE CAP FOR FOOTWEAR

[76] Inventor: Chia-Chin Wang, No. 9, Alley 12, Lane 882, Chung-Cheng Rd., Feng-Yuan City, Taichung Hsien, Taiwan

[21] Appl. No.: 968,470

[22] Filed: Nov. 12, 1997

[51] Int. Cl.[6] ..... A43C 13/14

[52] U.S. Cl. ..... 36/77 R; 36/77 M

[58] Field of Search ..... 36/77 R, 77 M

[56] References Cited

U.S. PATENT DOCUMENTS

| | | |
|---|---|---|
| 1,715,299 | 5/1929 | MacDonald . |
| 1,997,344 | 4/1935 | Randall et al. . |
| 2,120,107 | 6/1938 | Mathey . |
| 2,401,574 | 6/1946 | La Chapelle . |
| 4,862,606 | 9/1989 | Siskind et al. . |

*Primary Examiner*—Ted Kavanaugh
*Attorney, Agent, or Firm*—Rosenberg, Klein & Bilker

[57] ABSTRACT

A toe cap includes an open end and a close end. The toe cap has a middle layer being a netted layer and having a longitudinal axis perpendicular to the close end, a fourth layer, a third, a second and a first composite fiber layer respectively disposed on an upper surface of the middle layer in sequence, and a fifth, a sixth, a seventh and an eight composite fiber layer respectively disposed to an lower surface of the middle layer in sequence. The first, the fourth, the fifth and the second composite fiber layer are respectively disposed to the middle layer at an angle of 0 degree, positive 30 degrees, positive 45 degrees and 90 degrees corresponding to the longitudinal axis. The eighth and the seventh composite fiber layer are respectively overlapped to the first and the second composite fiber layer at the same angles of the first and the second composite fiber layer.

7 Claims, 6 Drawing Sheets

TOE CAP FOR FOOTWEAR

BACKGROUND OF THE INVENTION

1. Field of the Invention

The present invention relates to a toe cap for footwear and, more particularly, to a toe cap having an improved structure and made of a plurality of layers of fibers which are overlapped with each other at different and desired angles.

2. Brief Description of the Prior Art

Conventional toe caps for footwear known to applicant are U.S. Pat. No. 4,862,606, "toe guard for footwear, process for its manufacture, and footwear so made" to Siskind et al., U.S. Pat. No. 3,837,026, "safety footwear and a manufacture thereof" to John R. White. Each of the toe caps disclosed in these patents includes at least two layers so as to enhance a structural strength thereof so as to protect feet in the footwear. Metallic and non-metallic toe caps are well known in the art. However, the metallic toe caps cannot be used in a work place having electrical risks and magnetic risks. In addition, the non-metallic toe caps has a shortcoming of its poor structural strength and extensibility.

The present invention intends to provide an improved toe cap to mitigate and/or obviate the above-mentioned problems.

SUMMARY OF THE INVENTION

In one aspect of the present invention, there is provided a toe cap having an open end and a close end, and comprising a netted middle layer and having a longitudinal axis perpendicular to the close end, a fourth layer disposed on an upper surface of the middle layer at a an angle of positive degrees corresponding to the longitudinal axis of the middle layer, a third layer disposed on the fourth layer at an angle of negative degrees corresponding to the longitudinal axis, a second layer disposed on the third layer at an angle of 0 degrees corresponding to the close end of the toe cap, a first layer disposed on the second layer at an angle of 90 degrees corresponding to the close end of the toe cap, a fifth layer disposed on an lower surface of the middle layer at an angle of positive 45 degrees corresponding to the longitudinal axis.

A sixth layer is disposed to the fifth layer at an angle of negative 30 degrees corresponding to the longitudinal axis of the middle layer, a seventh layer disposed to the sixth layer at an angle of 0 degrees corresponding to the close end of the toe cap, and an eighth layer disposed to the seventh layer at an angle of 90 degrees corresponding to the close end of the toe cap.

It is an object of the present invention to provide a toe cap having a netted middle layer.

It is another object of the present invention to provide a toe cap including eight composite fiber layers respectively disposed to the middle layer thereof in sequence.

It is a further object of the present invention to provide a toe cap having a serrated upper surface.

Other objects, advantages, and novel features of the invention will become more apparent from the following detailed description when taken in conjunction with the accompanying drawings.

DETAILED DESCRIPTION OF THE PREFERRED EMBODIMENTS

Figure 1:
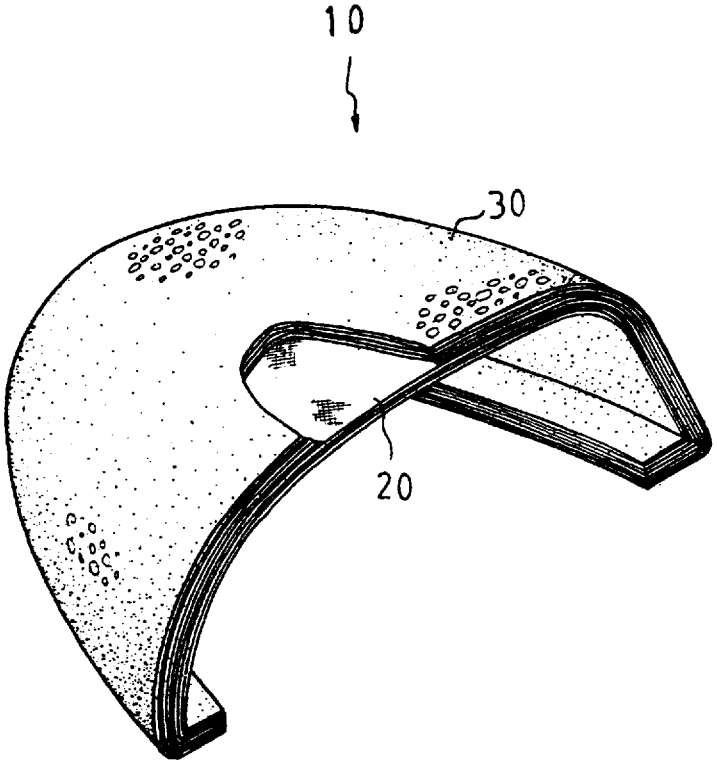
FIG. 1 is a perspective view of a toe cap, partly being removed, in accordance with the present invention.
Figure 2:
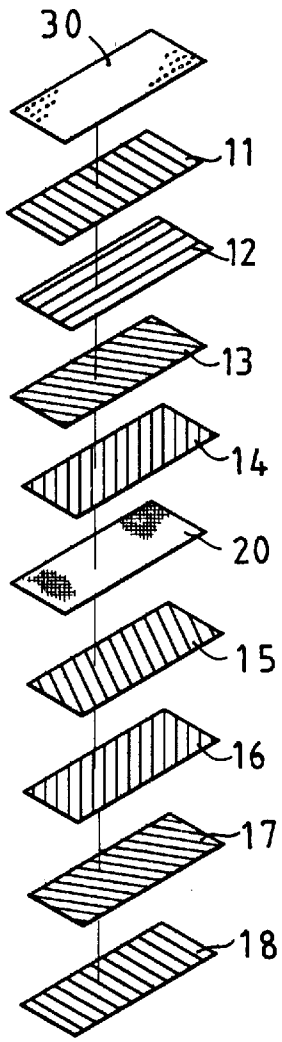
FIG. 2 is an exploded view to illustrate layers composed of the toe cap in accordance with the present invention.
Figure 3:
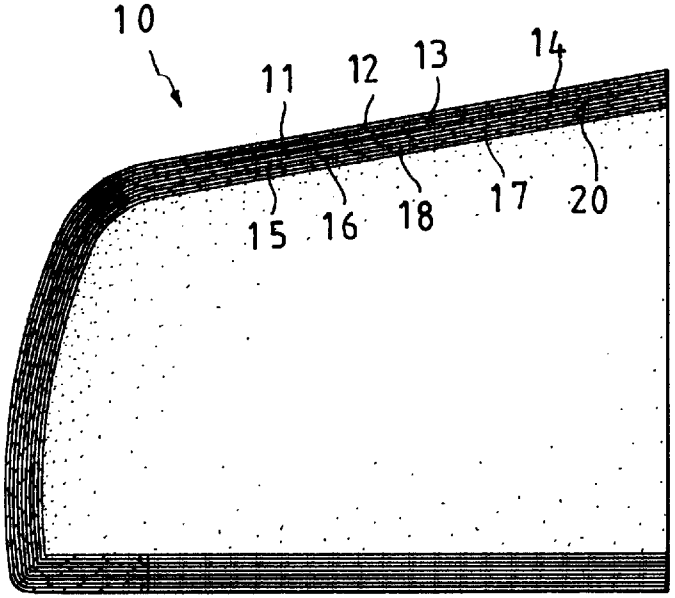
FIG. 3 is a side elevational view, partly in section, of the toe cap.
Figure 4:
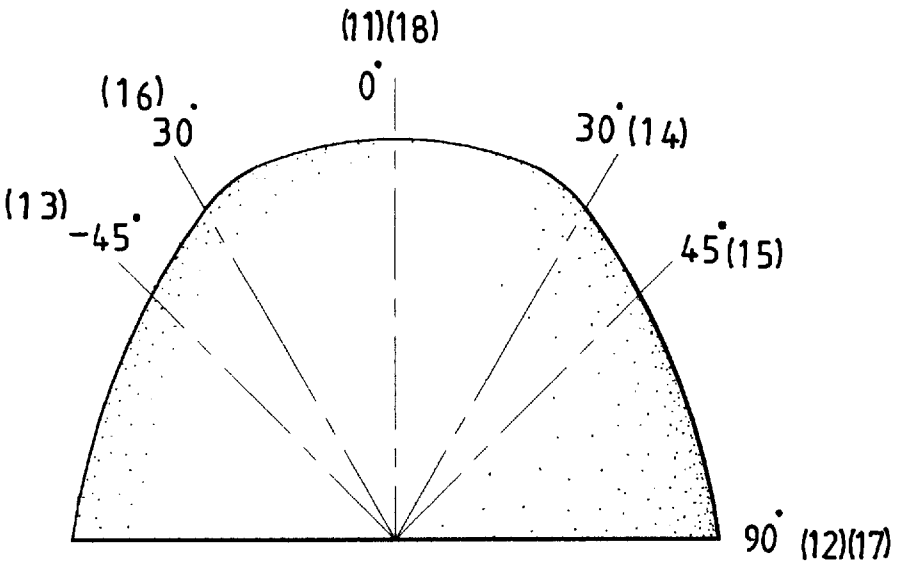
FIG. 4 is an illustrative view to show different angles at which the layers are disposed to a middle layer of the toe cap.
Figure 5:
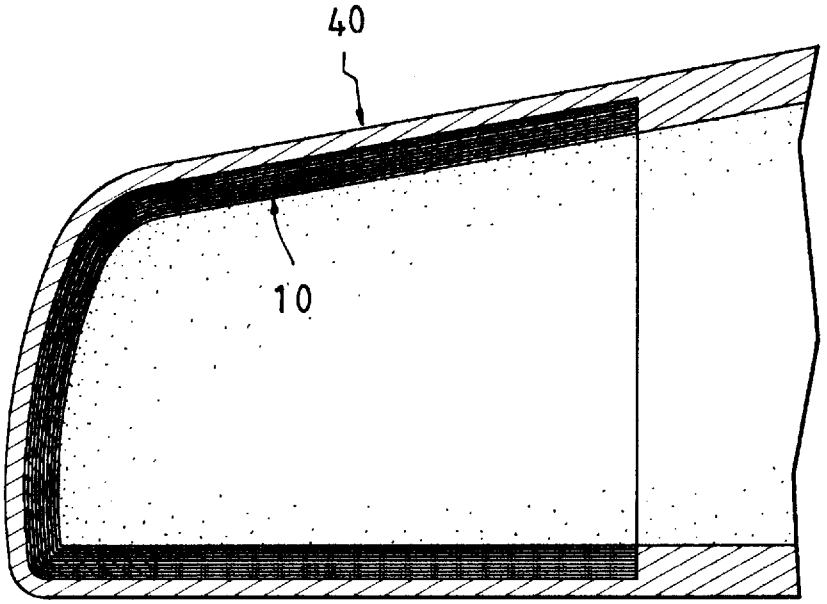
FIG. 5 is a side elevational view, partly in section, of the toe cap received in a shoe.

Referring to the drawings and initially to FIGS. 1 through 5, a toe cap 10 in accordance with the present invention generally includes an open end and a close end so as to be received in a shoe 40 as shown in FIG. 5. The toe cap 10 comprises a middle layer 20 being a netted layer and having a longitudinal axis perpendicular to the close end, a fourth layer 14 disposed on an upper surface of the middle layer 20 at a an angle of positive 30 degrees corresponding to the longitudinal axis of the middle layer 20, a third layer 13 disposed on the fourth layer 14 at an angle of negative 45 degrees corresponding to the longitudinal axis of the middle layer 20, a second layer 12 disposed on the third layer 13 at an angle of 0 degrees corresponding to the close end of the toe cap 10, a first layer 11 disposed on the second layer 12 at an angle of 90 degrees corresponding to the close end of the toe cap 10, a fifth layer 15 disposed on an lower surface of the middle layer 20 at an angle of positive 45 degrees corresponding to the longitudinal axis of the middle layer 20, a sixth layer 16 disposed to the fifth layer 15 at an angle of negative 30 degrees corresponding to the longitudinal axis of the middle layer 20, a seventh layer 17 disposed to the sixth layer 16 at an angle of 0 degrees corresponding to the close end of the toe cap 10, and an eighth layer 18 disposed to the seventh layer 17 at an angle of 90 degrees corresponding to the close end of the toe cap 10. Each of the first, the second, the third, the fourth, the fifth, the sixth, the seventh and the eighth layer is a composite fiber layer. The first layer 11 has a decorative layer 30 disposed thereon so as to have an esthetic outer appearance.

Figure 6:
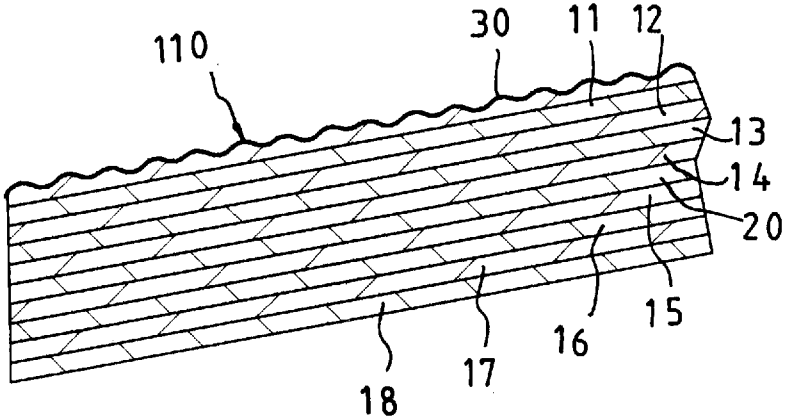
FIG. 6 is a side elevational view, partly in section, of a second embodiment of the toe cap.

Referring now to FIG. 6, a second embodiment of the toe cap of the present invention has a serrated upper surface 110 so as to enhance a structural strength of the toe cap and increase an ability of bearing an upper load applied on the serrated upper surface 110.

The netted middle layer 20 increases an expansibility of the toe cap 10 and can be made by weaving strips of composite fiber, meshes defined in the netted middle layer 20 can be adjusted according to needs.

Although the invention has been explained in relation to its preferred embodiment, it is to be understood that many other possible modifications and variations can be made without departing from the spirit and scope of the invention as hereinafter claimed.

What is claimed is:

1. A toe cap having an open end and a close end, comprising:

a middle layer being a netted layer and having a longitudinal axis perpendicular to said close end;

fourth layer disposed on an upper surface of said middle layer with fibers oriented at a an angle of positive 30 degrees corresponding to said longitudinal axis of said middle layer;

a third layer disposed on said fourth layer with fibers oriented at an angle of negative 45 degrees corresponding to said longitudinal axis of said middle layer;

a second layer disposed on said third layer with fibers oriented at an angle of 0 degrees corresponding to said close end of said toe cap;

a first layer disposed on said second layer with fibers oriented at an angle of 90 degrees corresponding to said close end of said toe cap;

a fifth layer disposed on an lower surface of said middle layer with fibers oriented at an angle of positive 45 degrees corresponding to said longitudinal axis of said middle layer;

a sixth layer disposed to said fifth layer with fibers oriented at an angle of negative 30 degrees corresponding to said longitudinal axis of said middle layer;

a seventh layer disposed to said sixth layer with fibers oriented at an angle of 0 degrees corresponding to said close end of said toe cap, and an eighth layer disposed to said seventh layer with fibers oriented at an angle of 90 degrees corresponding to said close end of said toe cap.

2. The toe cap as claimed in claim 1 wherein said first layer has a decorative layer disposed thereon.

3. The toe cap as claimed in claim 1 wherein each of said first, said second, said third, said fourth, said fifth, said sixth, said seventh and said eighth layer is a composite fiber layer.

4. The toe cap as claimed in claim 1 further having a serrated upper surface.

5. A toe cap having an open end, a close end and a serrated upper surface, comprising:

a middle layer being a netted layer and having a longitudinal axis perpendicular to said close end;

a fourth layer disposed on an upper surface of said middle layer with fibers oriented at a an angle of positive 30 degrees corresponding to said longitudinal axis of said middle layer;

a third layer disposed on said fourth layer with fibers oriented at an angle of negative 45 degrees corresponding to said longitudinal axis of said middle layer;

a second layer disposed on said third layer with fibers oriented at an angle of 0 degrees corresponding to said close end of said toe cap;

a first layer disposed on said second layer with fibers oriented at an angle of 90 degrees corresponding to said close end of said toe cap;

a fifth layer disposed on an lower surface of said middle layer with fibers oriented at a an angle of positive 45 degrees corresponding to said longitudinal axis of said middle layer;

a sixth layer disposed to said fifth layer with fibers oriented at an angle of negative 30 degrees corresponding to said longitudinal axis of said middle layer;

a seventh layer disposed to said sixth layer with fibers oriented at an angle of 0 degrees corresponding to said close end of said toe cap, and an eighth layer disposed to said seventh layer with fibers oriented at an angle of 90 degrees corresponding to said close end of said toe cap.

6. The toe cap as claimed in claim 5 wherein said first layer has a decorative layer disposed thereon.

7. The toe cap as claimed in claim 5 wherein each of said first, second, third, fourth, fifth, sixth, seven and eight layer is a composite fiber layer.

* * * * *